United States Patent [19]

Bernardin et al.

[11] Patent Number: 4,884,684

[45] Date of Patent: Dec. 5, 1989

[54] CONTAINMENT DEVICE FOR BIOLOGICAL MATERIALS

[75] Inventors: Rodney A. Bernardin, Stillwater; Laurel A. Hanken, St. Paul; Thomas I. Insley, Lake Elmo; Alice C. Murray, Maplewood, all of Minn.

[73] Assignee: Minnesota Mining and Manufacturing Company, St. Paul, Minn.

[21] Appl. No.: 190,991

[22] Filed: May 6, 1988

[51] Int. Cl.[4] ..... B65D 81/26; B65D 81/02

[52] U.S. Cl. ..... 206/204; 206/523; 206/589; 206/592

[58] Field of Search ..... 206/204, 523, 589, 592

[56] References Cited

U.S. PATENT DOCUMENTS

| | | | |
|---|---|---|---|
| Re. 24,767 | 1/1960 | Simon et al. | 206/46 |
| 2,780,350 | 2/1957 | Simon et al. | 206/46 |
| 2,929,425 | 3/1960 | Slaughter | 150/1 |
| 2,941,708 | 6/1960 | Crane | 229/2.5 |
| 3,146,929 | 9/1964 | Keim | 206/589 X |
| 3,309,893 | 3/1967 | Heffler et al. | 62/372 |
| 3,621,994 | 11/1971 | Brown | 206/65 R |
| 3,768,724 | 10/1973 | Hill | 229/53 |
| 3,871,521 | 3/1975 | Szatkowski | 206/524 |
| 3,948,436 | 4/1976 | Bambara | 229/55 |
| 3,971,373 | 7/1976 | Braun | 128/146.2 |
| 3,999,653 | 12/1976 | Haigh et al. | 206/584 |
| 4,087,002 | 5/1978 | Bambara et al. | 206/523 |
| 4,118,531 | 10/1978 | Hauser | 428/224 |
| 4,173,286 | 11/1979 | Stanko | 206/589 X |
| 4,213,528 | 7/1980 | Kreutz et al. | 206/205 |
| 4,240,547 | 12/1980 | Taylor | 206/523 X |
| 4,429,001 | 1/1984 | Kolpin et al. | 428/283 |
| 4,481,779 | 11/1984 | Barthel | 62/48 |
| 4,495,775 | 1/1985 | Young et al. | 62/48 |
| 4,560,069 | 12/1985 | Simon | 206/591 |
| 4,573,578 | 3/1986 | Greminger, Jr. et al. | 206/524.4 |
| 4,584,822 | 4/1986 | Fielding et al. | 53/452 |

OTHER PUBLICATIONS

Arimond, John, Shock Control: Better Way to Select Materials, Machine Design, (May 21, 1987) pp. 109–112.

*Primary Examiner*—Allen M. Ostrager

*Attorney, Agent, or Firm*—Donald M. Sell; Walter N. Kirn; Stephen W. Bauer

[57] ABSTRACT

A containment device for sealing and protecting containers of biological materials. The device comprises a resilient cushion of aqueous fluid sorbent material having a plurality of openings. Each opening is adapted for receiving a respective container of biological material, and the openings are arranged such that each opening is surrounded by sufficient sorbent material to sorb leakage of biological material from its respective container if the container and/or if any additional containers break. The device also includes a case of aqueous fluid resistant material for receiving and enveloping the fluid sorbent material. The case includes two generally stiff-flexible portions having parts adapted for complementary interengagement and adapted to receive means for sealing the portions together to form an air and fluid tight package.

21 Claims, 3 Drawing Sheets

CONTAINMENT DEVICE FOR BIOLOGICAL MATERIALS

FIELD OF THE INVENTION

This invention relates generally to containers, and more particularly to a containment device for shipping or handling biological materials.

BACKGROUND OF THE INVENTION

Heretofore, biological materials, such as samples generated for diagnostic testing, have been shipped in foam, e.g., polystyrene foam, cases comprising two portions having cavities or openings for receiving individual sample vials. The portions of the case may be fastened together to hold the vials inside, and the case may be placed in a conventional shipping box. While polystyrene foam cases may provide some shock absorbency to protect the samples, they do not sorb leaking fluid if one or more vials breaks. As a result, biological material may leak through the case and box, in which case persons handling the shipping boxes will also contact the material.

U.S. Pat. No. 4,560,069 discloses a package for hazardous materials that includes a metal can, in which non-resilient and frangible foam elements are inserted for cushioning a bottle of such material and absorbing leakage if the bottle breaks. The foam elements are formed of open-celled, phenol-formaldehyde foam. Fiberboard spacers are provided to isolate the foam elements from the bottle to protect the foam. Because the foam elements are non-resilient and frangible, they will break down under impact or when crushed, with the result that their ability to absorb fluid is reduced when it is most needed. Moreover, in some cases, the leakage may only be detected after opening the can, for example, if the can is undamaged.

Various other containers or bags for holding samples of materials include a bag employing ethyl cellulose as a sorbent disclosed in U.S. Pat. No. 4,573,578; shipping bags having a layer of cushioning material disclosed in U.S. Pat. Nos. 3,768,724, 3,948,436 and 4,087,002; and a specimen mailer disclosed in U.S. Pat. No. 3,621,994 comprising nested plastic cups separated by resilient foam and a divider structure within the inner cup for holding four test tubes. U.S. Pat. No. 3,871,521 discloses a container comprising two shells filled with a foamed cellular polymer.

SUMMARY OF THE INVENTION

The present invention provides a containment device which is particularly useful for protecting sample containers used in diagnostic test kits from impact or mishandling during shipment, sealing the sample containers inside the device to prevent biological test samples from leaking from the device, and sorbing leakage from the containers due to breakage of or defects in the containers.

Generally, a containment device of the invention is adapted for sealing and protecting containers of hazardous or biological materials. The containment device comprises a resilient cushion of aqueous fluid sorbent material having a plurality of openings. Each opening is adapted for receiving a respective container of hazardous or biological material, and the openings are arranged such that each opening is surrounded by sufficient sorbent material to sorb leakage of hazardous or biological material from its respective container if the container and/or if any additional containers break. A case of aqueous fluid resistant material is provided for receiving and enveloping the fluid sorbent material. The case includes two generally stiff-flexible portions having parts adapted for complementary interengagement and adapted to receive means for sealing the portions together to form an air and fluid tight package.

Preferably, each portion of the case includes a base and a flange providing the parts and extending generally perpendicularly from the perimeter of the base. The flanges are adapted for overlapping interengagement, and tape is provided for holding and sealing the flanges together. Reinforcing means may also be provided adjacent the cushion for providing rigidity to the case. The reinforcing means includes a reinforcing strip of generally rigid material positioned between the flanges and the cushion, and the reinforcing strip is sized to maintain sufficient spacing between the bases of the portions of the case for the cushion to be received therein while permitting the flanges of the portions to overlap.

Also, preferably, the cushion has sufficient aqueous fluid sorbent material around each opening to isolate each container from its nearest other containers so that if biological material leaks from one or more containers it will be isolated from the other containers. This may be accomplished, for example, by providing sufficient aqueous fluid sorbent material around each opening to afford a leak-sorbing safety factor of three or higher around each opening. The cushion may have a percentage void volume available for sorbing aqueous fluid of between approximately 50 and 95 percent. The cushion may be formed of a nonwoven, fibrous polyolefinic material treated with a surfactant so that it is able to sorb aqueous fluids.

A second aspect of this invention is a containment device adapted for sealing and protecting a container of hazardous or biological materials. The containment device comprises a resilient cushion of aqueous fluid sorbent material having an opening adapted for receiving a container of hazardous or biological material. The opening is surrounded by sufficient sorbent material to sorb leakage of hazardous or biological material from the container if it breaks. A case of aqueous fluid resistant material is provided for receiving and enveloping the fluid sorbent material. The case includes two generally stiff-flexible portions, and each portion has a base and a flange extending from the perimeter of the base. The flanges are adapted for overlapping interengagement and adapted to receive means for sealing the portions together to form an air and fluid tight package.

Other features will be in part apparent and in part pointed out hereinafter.

BRIEF DESCRIPTION OF THE DRAWINGS

The present invention will be further described with reference to the accompanying drawings wherein like reference characters indicate corresponding parts in the several views, and wherein.

DETAILED DESCRIPTION

Figure 1:
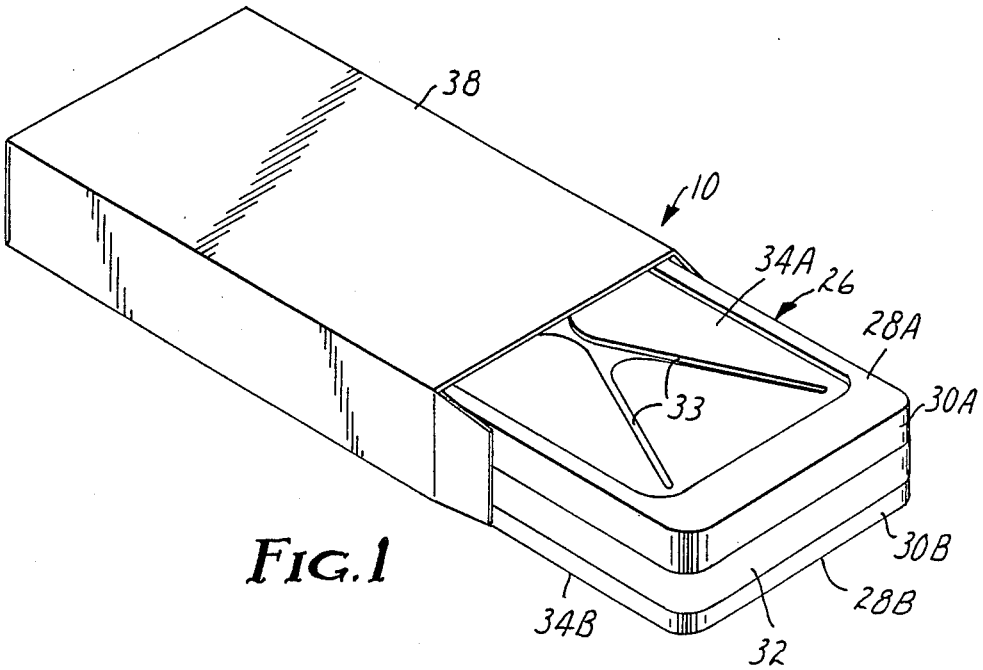
FIG. 1 is a perspective view of a containment device of the present invention, showing a case partially inserted into a box.
Figure 2:
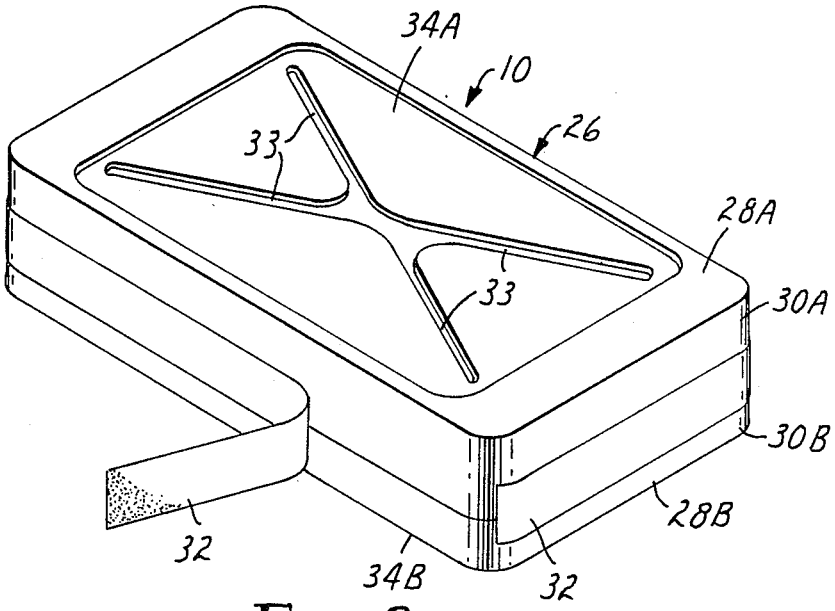
FIG. 2 is a perspective view of the case of FIG. 1.

Now referring to the drawings, a containment device of the present invention is designated in its entirety by the reference numeral 10, and is particularly adapted for sealing and protecting containers, e.g., vials 12A–H, holding biological or other potentially hazardous materials so that they may be shipped to a testing laboratory.

Figure 3:
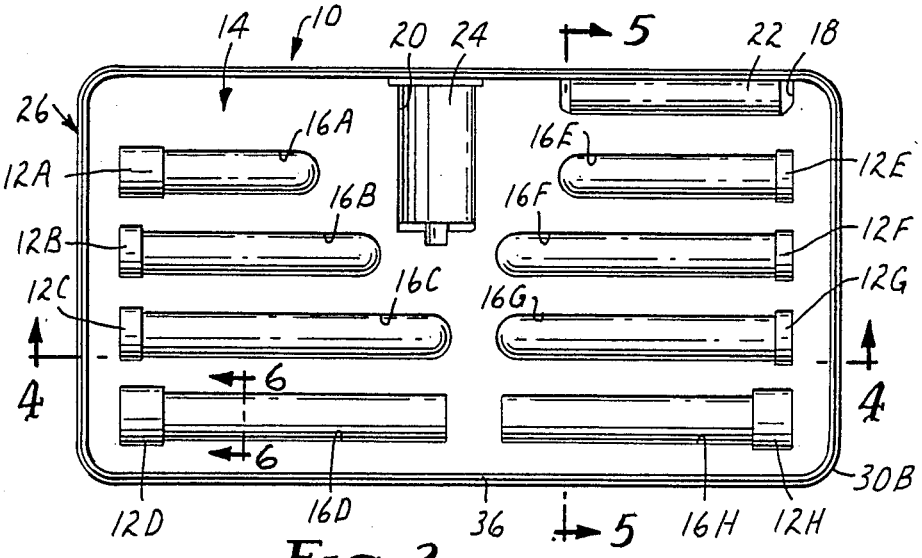
FIG. 3 is a top plan view of the bottom portion of the containment device of FIGS. 1 and 2.
Figure 4:
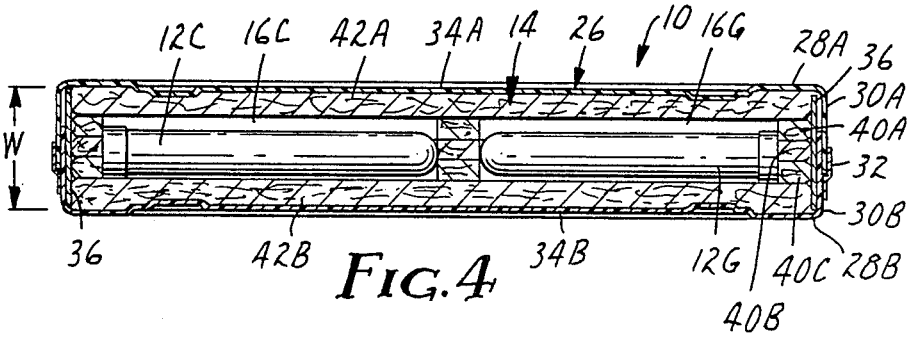
FIG. 4 is a cross-sectional view substantially along line 4—4 of FIG. 3.
Figure 5:
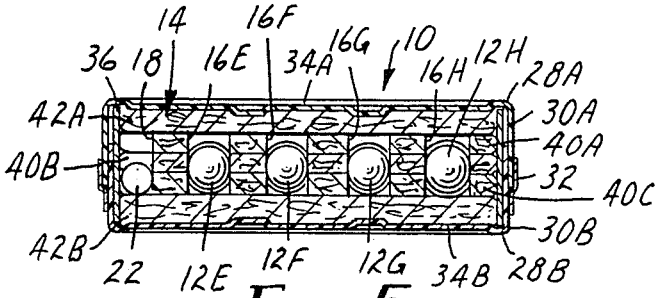
FIG. 5 is a cross-sectional view substantially along line 5—5 of FIG. 3.

As shown in FIG. 3, the containment device 10 generally includes a resilient, aqueous-fluid sorbent cushion generally designated 14, in which a plurality of openings 16A–H, 18 and 20 are formed. Openings 16A–H are adapted for receiving containers, e.g., the vials 12A–H, respectively, of biological material, and openings 18 and 20 are preferably adapted for receiving a hypodermic needle sheath 22 and vial-receiving barrel 24, respectively, so that the containment device 10 is capable of holding the necessary utensils for obtaining blood and urine samples. As used herein, "opening" refers to any type of space or cavity in the cushion for receiving such containers or utensils. The openings 16A–H are arranged such that each opening is surrounded by sufficient sorbent material 14 to sorb leakage of biological material from its respective container if the container and/or if any additional containers break. Openings 16A–H may be sized slightly smaller than the size of the vials 12A–H so that the cushion material surrounding each opening is slightly compressed to hold the vials in place, or, alternatively, the openings may consist of slits in the cushion 14 that are adapted to open sufficiently to accommodate the vials. A case 26 of aqueous fluid resistant material (e.g., polyvinyl chloride) is provided for receiving and enveloping the fluid sorbent material 14. The case 26 includes two generally stiff-flexible portions 28A and B, constituting top and bottom portions, respectively, of the case. The portions 28A and 28B are preferably readily separable to provide access to the contents of the case, although the portions may be permanently or semi-permanently interconnected by, for example, a hinge (not shown) without departing from the scope of the present invention. The portions 28A, 28B of the case 26 have parts (e.g., flanges 30A and B) adapted for complementary and preferably overlapping interengagement. The flanges 30A and B are also adapted to receive means, such as adhesive tape 32, for sealing the portions 28A and B together to form an air and fluid tight package, it being observed that one advantage of providing an air tight seal is that the case 26 functions similarly to an air cushion to further protect the vials.

The portions 28A, 28B of the case 26 in addition to the flanges 30A, 30B, include generally planar bases 34A and 34B, respectively, having generally rectangular perimeters. The flanges 30A, 30B extend generally perpendicularly from the perimeters of their respective bases 34A, 34B in such a manner that they are adapted for overlapping inner-to-outer surface interengagement when the portions 28A and 28B are brought together to enclose the cushion 14. The tape 32 is centered with respect to the overlapped portions of the flanges 30A, 30B, and applied to the flanges to hold them in position and to seal them together. It will be observed that the overlap of the flanges 30A, 30B also serves to increase the rigidity of the case 26. The portions 28A, 28B of the case 26 may be vacuum-molded of 0.25–1.3 mm thick sheets of plasticized polyvinyl chloride, which are preferably generally transparent or translucent so that leakage from the containers may be observed without opening the case. Diagonal ribs 33 may be molded in the bases 34A, 34B to provide additional rigidity to the case 26.

Reinforcing means (e.g., reinforcing strip 36) may be provided adjacent the cushion 14 to increase the rigidity of the case 26. The reinforcing strip 36 is formed of generally rigid material (e.g., generally rigid 0.5 mm thick fiberboard or cardboard), and is positioned between the flanges 30A, 30B and the cushion 14, thereby providing a rigid backing for the flanges to facilitate applying the tape 32 thereto. The reinforcing strip 36 is sized to maintain sufficient spacing between the bases 34A, 34B of the portions 28A, 28B of the case 26 for the cushion 14 to be received therein without being crushed while permitting the flanges 30A, 30B of the portions to overlap. For example, if the desired thickness of the cushion 14 is about 40 mm, the reinforcing strip 36 may have a width W of approximately 40 mm, and the flanges may each have a width of approximately 28 mm so that the flanges have about 16 mm of overlap when the portions 28A, 28B are brought together. The reinforcing means may also include one or more reinforcing sheets (not shown) positioned between one or both of the bases 34A, 34B and the cushion 14 to further increase the rigidity and puncture resistance of the case 26. The reinforcing sheets may be formed of material similar to that of the case 26. A tubular shipping box 38 having a rectangular cross section may also be provided for receiving the case 26 and protecting it.

Figure 6:
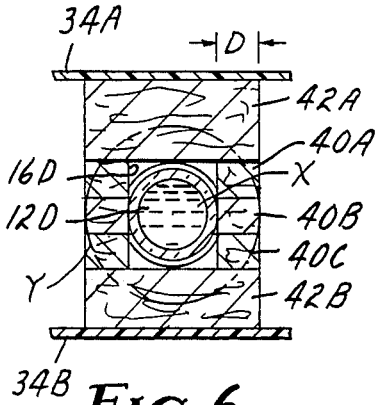
FIG. 6 is a cross-sectional view substantially along line 6—6 of FIG. 3, showing a vial and cushion material surrounding the vial.

The cushion 14 preferably has sufficient aqueous fluid sorbent material around each opening 16A–H to isolate each container 12A–H from its nearest other containers so that if biological material leaks from one or more containers it will be substantially completely sorbed in the material and isolated from the other containers. Most preferably, sufficient aqueous fluid sorbent material is provided around each opening 16A–H to afford a leak-sorbing safety factor of three or higher around each opening. As illustrated in FIG. 6, this may be accomplished by calculating the cross-sectional area X of the vial, multiplying the area X by the safety factor three, and dividing the result by the percentage void volume of the sorbent material available for sorbing fluid to determine the minimum annular cross-sectional area Y of sorbent material required around the opening. The cross-sectional area Y may be used to determine the minimum dimension D of material enveloping or surrounding the vial along its length and adjacent its ends (e.g., dimension D equals the radius of area Y minus the radius of a cylindrical vial). This calculation is performed for each size vial, and the amount of sorbent material surrounding each opening is provided accordingly, it being understood that adjacent vial-receiving openings are spaced by a distance at least as great as the sum of their minimum dimensions D.

The cushion 14 is formed of nonwoven, fibrous polyolefinic (e.g., polypropylene) material having a percentage void volume available for sorbing fluid of between approximately 50 and 95 percent and treated with a surfactant (e.g., sodium sulfosuccinic acid) so that it is capable of sorbing aqueous fluid in addition to many other fluids. For example, the cushion 14 may be formed of melt blown microfiber material, similar to that described in coassigned U.S. Pat. No. 4,118,531 and/or such as the universal sorbent sold under the trademark "Powersorb" by Minnesota Mining and Manufacturing Company of St. Paul, Minnesota. Discrete solid entities (e.g., particles, fibers, etc.) formed of superabsorbent polymeric material and/or deactivating or disinfectant material can be uniformly dispersed in the cushion material, as described in coassigned U.S. Pat. Nos. 3,971,373 and 4,429,001, so that they are adapted to interact with any aqueous fluid material and/or biological material which leaks into the cushion 14.

The cushion 14 preferably includes a plurality (e.g., three) of sheets 40A–C of "Powersorb" brand universal sorbent material secured or glued together in face-to-face relationship, in which the openings 16A–H, 18 and 20 are formed. Two sheets 42A, 42B of such sorbent material, in which no openings are formed, are secured or glued to the respective bases 34A, 34B of the portions 28A, 28B of the case 26. Sheets 40A–C may be glued to the sheet 42B that is secured to the base 34B of the bottom portion 28B so that when the top portion 28A is separated from the bottom portion, sheets 40A–C, vials 12A–H, hypodermic needle sheath 22 and vial-receiving barrel 24 remain in the bottom portion 28B of the case. Alternatively, a single thick pad (not shown) of such sorbent material may be provided in lieu of the three intermediate sheets 40A–C of material.

Figure 7:
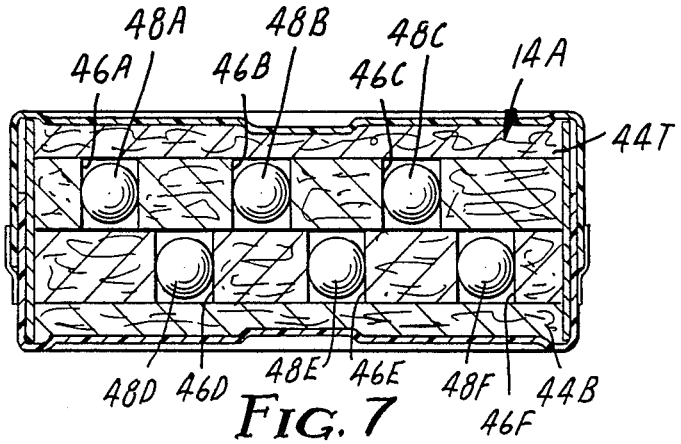
FIG. 7 is a cross-sectional view similar to FIG. 5, showing another embodiment of the invention.

FIG. 7 illustrates another embodiment of the invention wherein a cushion 14A includes separable top and bottom sections 44T and 44B, in which a plurality of staggered openings 46A–F are formed for receiving containers or vials 48A–F, respectively, of biological material. More specifically, the top section 44T of the cushion 14A may have three openings 46A–C that are staggered with respect to the openings 46D–F of the bottom section 44B so that less sorbent cushion material is required to isolate the vials from one another. The top and bottom sections 44T, 44B of the cushion **14*a* are adapted for face-to-face interengagement to isolate the containers from one another. The openings 46A–F are preferably sized slightly smaller than the size of the vials 48A–F so that the vials do not fall from the cushion when the case 26A** is opened.

As various changes could be made in the above constructions without departing from the scope of the invention, it is intended that all matter contained in the above description or shown in the accompanying drawing shall be interpreted as illustrative and not in a limiting sense.

We claim:

1. A containment device for sealing and protecting containers of hazardous or biological materials comprising a resilient energy-absorbent cushion of aqueous fluid sorbent material that retains its ability to sorb fluid after responding to impact, the cushion having a plurality of openings, each opening being adapted for receiving a respective container of hazardous or biological material, the openings being arranged such that each opening is surrounded by sufficient sorbent material to sorb leakage of material from its respective container if the container and/or if any additional containers break and to resiliently absorb impact energy when the device is impacted, with the material resiliently returning to its original configuration after impact, and a case of aqueous fluid resistant material for receiving and enveloping the fluid sorbent material, the case including two generally stiff-flexible portions having parts adapted for complementary interengagement and adapted to receive means for sealing the portions together to form an air and fluid tight package.

2. A containment device according to claim 1 wherein said parts overlap so that the sealing means holds the portions in overlapping relationship.

3. A containment device according to claim 2 further including tape to provide the sealing means for sealing the portions together.

4. A containment device according to claim 2 wherein each portion of the case includes a base and a flange providing the parts and extending generally perpendicularly from the perimeter of the base, the flanges being adapted for overlapping interengagement.

5. A containment device according to claim 4 wherein the portions of the case are separable.

6. A containment device according to claim 4 wherein the case is formed of transparent or translucent material that permits leakage from the containers to be observed without opening the case.

7. A containment device according to claim 4 further including reinforcing means adjacent the cushion for providing rigidity to the case.

8. A containment device according to claim 7 wherein the reinforcing means includes a reinforcing strip of generally rigid material positioned between the flanges and the cushion, the reinforcing strip being sized to maintain sufficient spacing between the bases of the portions of the case for the cushion to be received therein while permitting the flanges of the portions to overlap.

9. A containment device according to claim 8 wherein the reinforcing means further includes a reinforcing sheet positioned between at least one of the bases and the cushion.

10. A containment device according to claim 4 wherein the cushion includes a plurality of sheets of sorbent material secured together in face-to-face relationship.

11. A containment device according to claim 10 wherein the cushion includes a sheet of sorbent material secured to the base of each portion of the case.

12. A containment device according to claim 1 wherein the cushion includes two separable sections of aqueous fluid sorbent material in which the container-receiving openings are formed, the sections being adapted for face-to-face interengagement, and the openings of one section being staggered with respect to the openings of the other section.

13. A containment device according to claim 1 wherein the cushion has sufficient aqueous fluid sorbent material around each opening to isolate each container from its nearest other containers so that if hazardous or biological material leaks from one or more containers it will be isolated from other containers.

14. A containment device according to claim 13 wherein the cushion has sufficient aqueous fluid sorbent material around each opening to provide a leak-sorbing safety factor of three or higher around each opening.

15. A containment device according to claim 13 wherein the cushion has a percentage void volume available for sorbing aqueous fluid of between approximately 50 and 95 percent.

16. A containment device according to claim 15 wherein the cushion material includes nonwoven, fibrous surfactant-treated polyolefinic material.

17. A containment device according to claim 16 wherein the nonwoven, fibrous polyolefinic material includes blown microfiber material having discrete solid entities uniformly dispersed therein, the entities being adapted to interact with aqueous fluid material and/or biological material.

18. A containment device for sealing and protecting a container or hazardous or biological materials comprising a resilient energy-absorbent cushion of aqueous fluid sorbent material that retains its ability to sorb fluid after responding to impact, the cushion having an opening adapted for receiving a container of hazardous or biological material, the opening being surrounded by sufficient sorbent material to sorb leakage of material from the container if it breaks and to resiliently absorb impact energy when the device is impacted, with the material resilient returning to its original configuration after impact, and a case of aqueous fluid resistant material for receiving and enveloping the fluid sorbent material, the case including two generally stiff-flexible portions, each portion including a base and a flange extending from the perimeter of the base, the flanges being adapted for overlapping interengagement and adapted to receive means for sealing the portions together to form an air and fluid tight package.

19. A containment device according to claim 18 further including tape to provide the sealing means for sealing the portions together.

20. A containment device according to claim 18 further including reinforcing means adjacent the cushion for providing rigidity to the case, the reinforcing means including a reinforcing strip of generally rigid material positioned between the flanges and the cushion, the reinforcing strip being sized to maintain sufficient spacing between the bases of the portions of the case for the cushion to be received therein while permitting the flanges of the portions to overlap.

21. A containment device according to claim 18 wherein the case is formed of transparent or translucent material that permits leakage from the container to be observed without opening the case.

* * * * *